US008789745B1

(12) United States Patent
Barbary

(10) Patent No.: US 8,789,745 B1
(45) Date of Patent: Jul. 29, 2014

(54) PERSONAL SAVING SYSTEM

(71) Applicant: Anthony W. Barbary, Rockford, IL (US)

(72) Inventor: Anthony W. Barbary, Rockford, IL (US)

( * ) Notice: Subject to any disclaimer, the term of this patent is extended or adjusted under 35 U.S.C. 154(b) by 0 days.

(21) Appl. No.: 14/069,851

(22) Filed: Nov. 1, 2013

(51) Int. Cl.
*A47G 29/00* (2006.01)
*A45C 1/12* (2006.01)

(52) U.S. Cl.
CPC ..... *A45C 1/12* (2013.01)
USPC ..... 232/4 R; 446/8; 70/162; 70/267

(58) Field of Classification Search
USPC ..... 232/1 D, 4 R; D99/35; 446/8; 340/5.73; 70/63, 160, 162, 267–274, 278.1; 220/524
See application file for complete search history.

(56) References Cited

U.S. PATENT DOCUMENTS 1,631,965 A * 6/1927 Kaufman ..... 206/0.81
1,644,495 A * 10/1927 Shafer ..... 232/4 R
1,716,823 A * 6/1929 Ko Eune ..... 232/4 R
2,504,305 A * 4/1950 Cummings et al. ..... 70/272
4,982,585 A * 1/1991 Davis et al. ..... 70/269
5,594,430 A * 1/1997 Cutter et al. ..... 340/5.22
5,716,211 A * 2/1998 Vetter ..... 434/107
D436,427 S * 1/2001 Grendahl ..... D99/35
6,825,753 B2 11/2004 Cardinale et al.
6,896,573 B1 * 5/2005 Rogers ..... 446/8
7,464,570 B1 * 12/2008 Chen ..... 70/267
7,921,683 B2 * 4/2011 Largay, Jr. ..... 70/56
2002/0157437 A1 * 10/2002 Laurie ..... 70/272
2008/0108272 A1 * 5/2008 Lin ..... 446/8
2011/0290870 A1 * 12/2011 Ramsaroop ..... 232/5
2012/0244776 A1 * 9/2012 Burns ..... 446/8

* cited by examiner

*Primary Examiner* — William Miller

(57) ABSTRACT

A personal saving system for accumulating saved funds and allowing access to the saved funds after an elapsed timeframe features a sturdy hollow container having an open top and vertical dividers inside that create a plurality of chambers. The system features a plurality of lids pivotally located on the container, one above each chamber. The system features an elapsed time latch release system having a battery power supply and a microprocessor. The release system features a display, a money slot, one or more user interface components, and a demo button all located on a lid top surface. The release system features a latch first component located on a lid front and a latch second component located on a container front surface next to the latch first component when the lid is in a closed position.

1 Claim, 6 Drawing Sheets

TOP VIEW

FRONT VIEW

SIDE VIEW (CYLINDER VERSION)

(CYLINDER VERSION)

PERSONAL SAVING SYSTEM

FIELD OF THE INVENTION

The present invention relates to small portable savings "banks", or more specifically, small, portable savings "banks" using a timed release means to access saved funds.

BACKGROUND OF THE INVENTION

"Piggy Banks" as they have become known, have been in use for many years. In times past, a person would place money through a slot in the bank for savings, then for access to the savings, the bank would have to be destroyed, thus creating a hindrance to the saver for easily accessing the money. As time went on, capped holes were sometimes placed at the bottom of the bank for easier access without breaking the bank. The present invention features a bank system using a timed release means for accessing the saved funds.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a personal saving system for accumulating saved funds and allowing access to the saved funds after an elapsed timeframe. In some embodiments, the system comprises a sturdy hollow container having an open top and one or more vertical dividers located inside that create a plurality of chambers. In some embodiments, the system comprises one or more lids pivotally located on the container, one above each chamber.

In some embodiments, the system comprises an elapsed time latch release system featuring a lithium or alkaline battery power supply and a microprocessor. In some embodiments, the release system comprises a display located on a lid top surface. In some embodiments, the release system comprises a latch first component located on a lid front of each lid and a latch second component located on a container front surface next to the latch first component when the lid is in a closed position. In some embodiments, the release system comprises a money slot located on the lid top surface. In some embodiments, the release system comprises one or more user interface components located on the lid top surface. In some embodiments, the release system comprises a demo button for initiating a demonstration cycle of the time release system.

DESCRIPTION OF PREFERRED EMBODIMENTS

Figure 1:
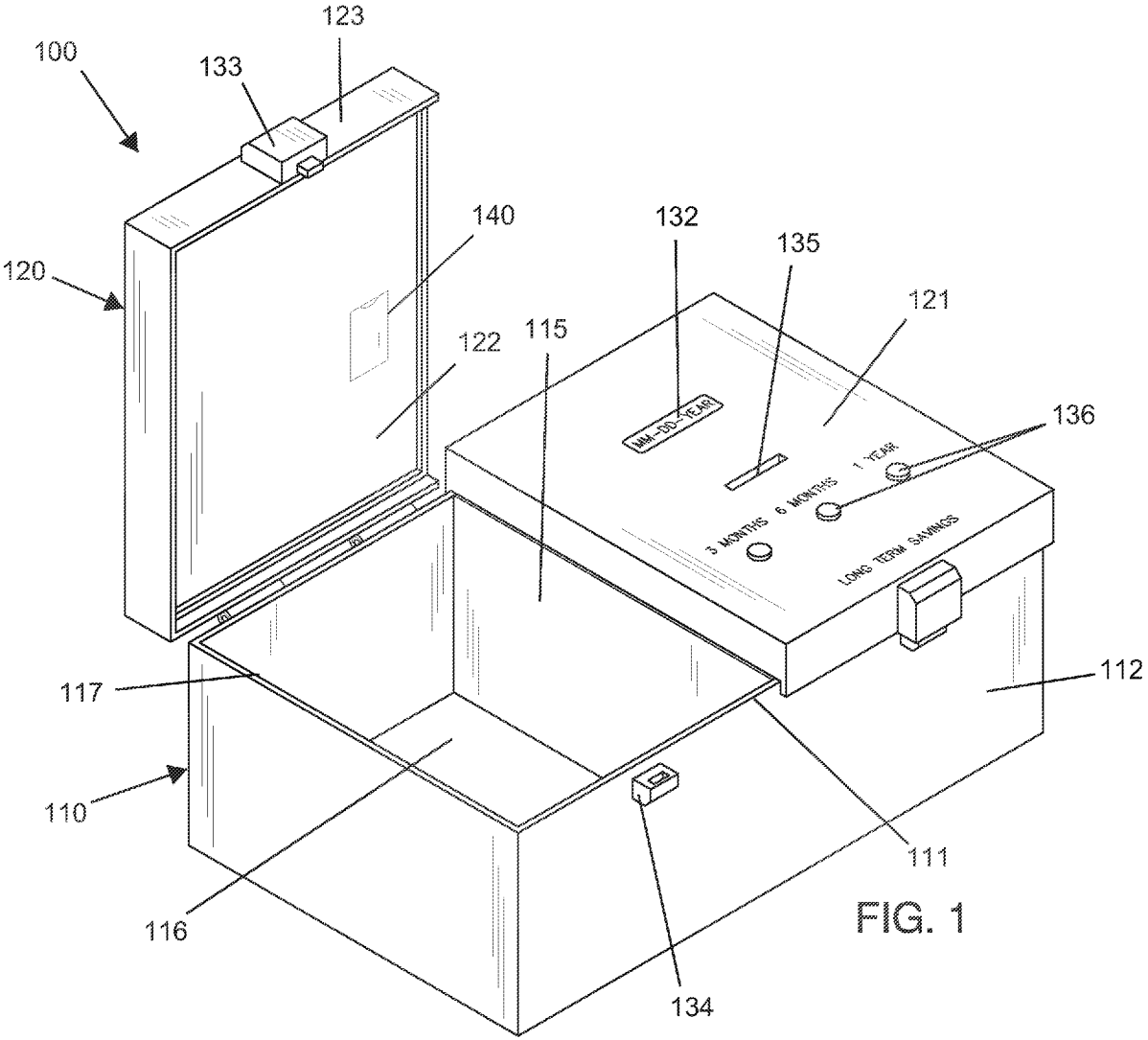
FIG. 1 shows a perspective view of the present invention.
Figure 2:
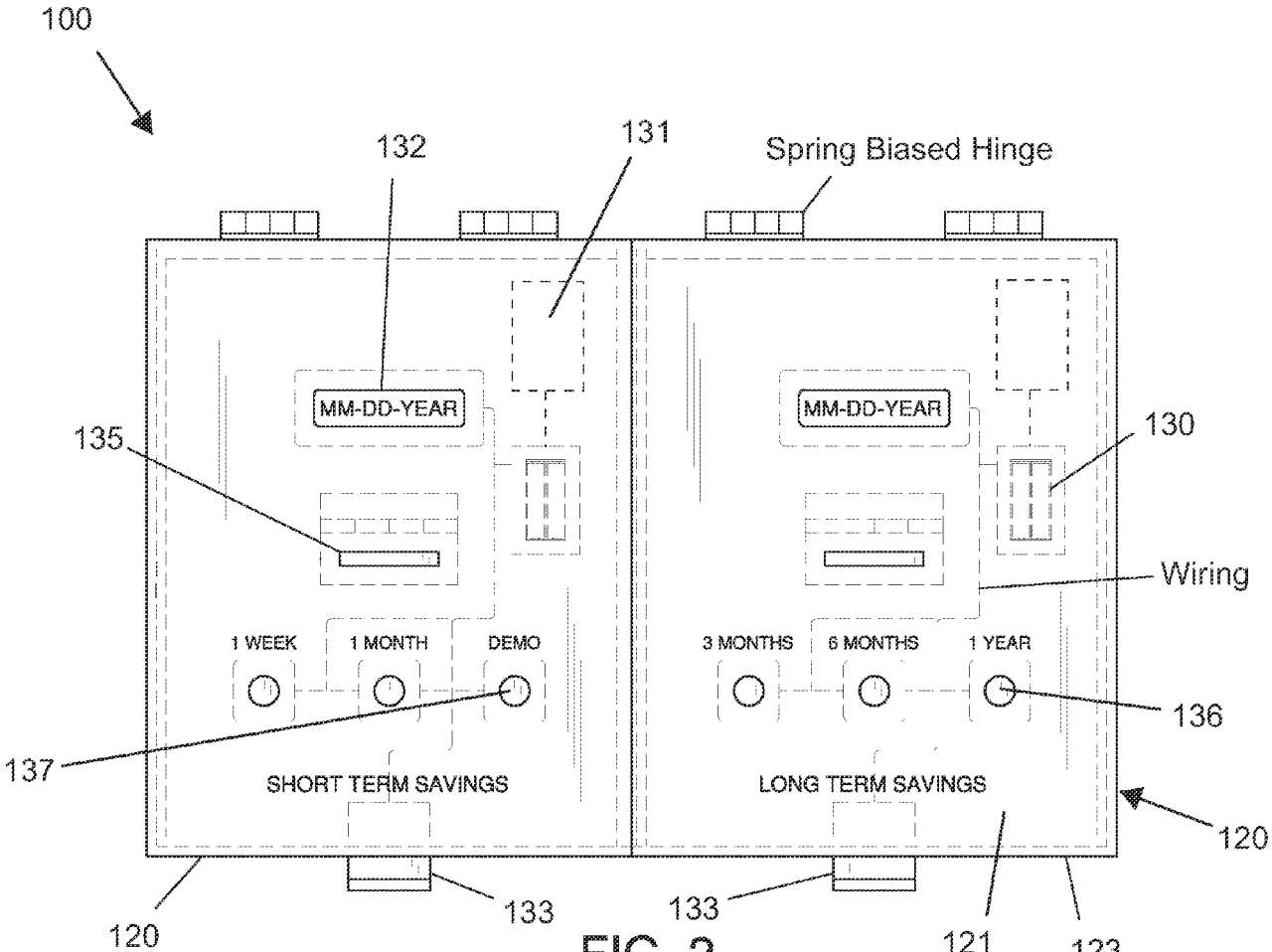
FIG. 2 shows a top view of the present invention.
Figure 3:
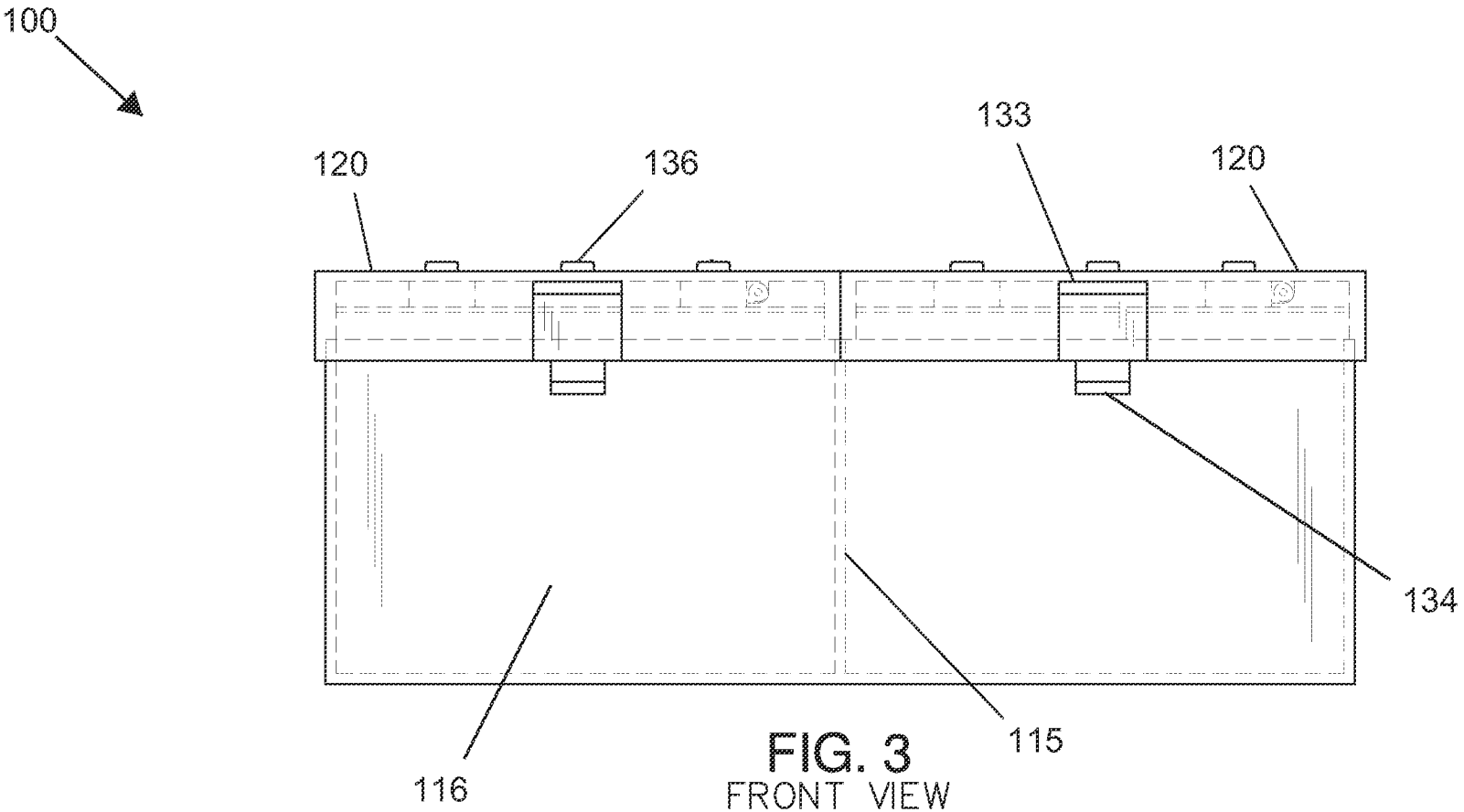
FIG. 3 shows a front view of the present invention.
Figure 4:
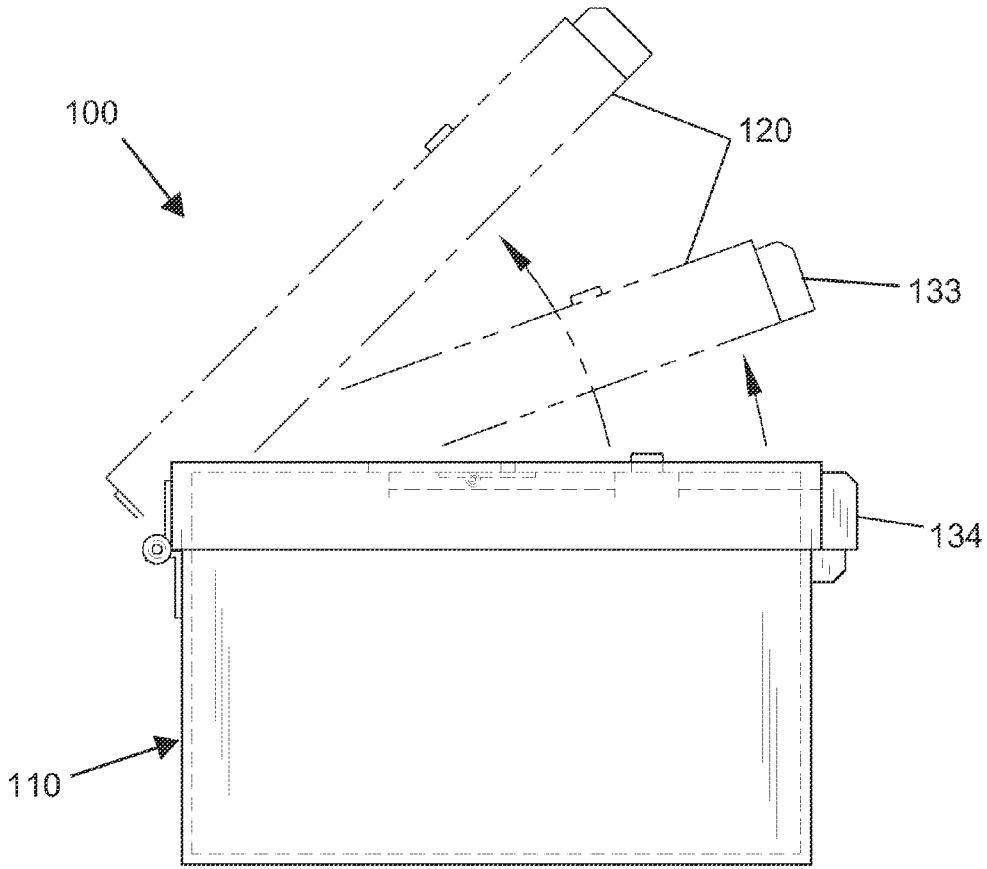
FIG. 4 shows a side view of the present invention.
Figure 5:
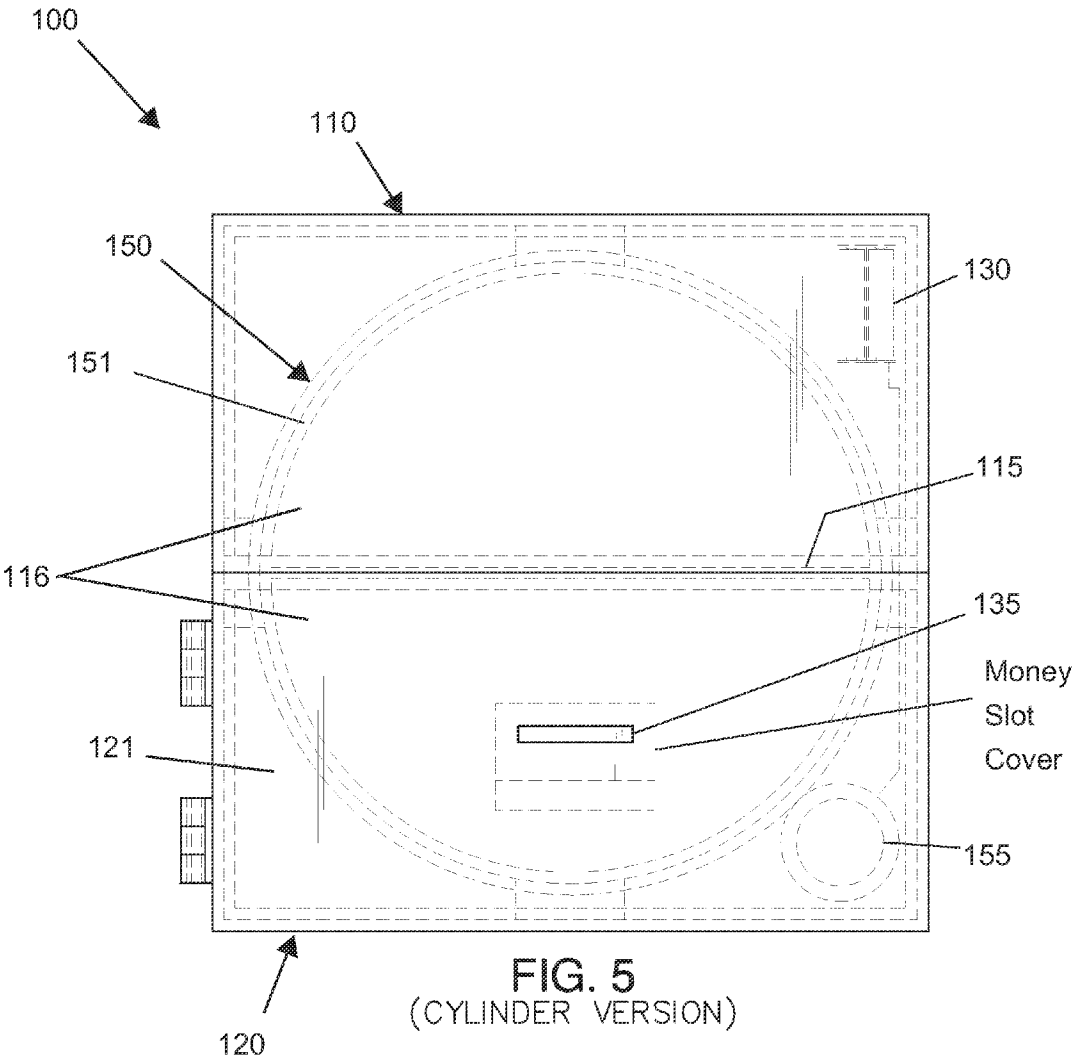
FIG. 5 shows a top view of an alternate embodiment of the present invention.
Figure 6:
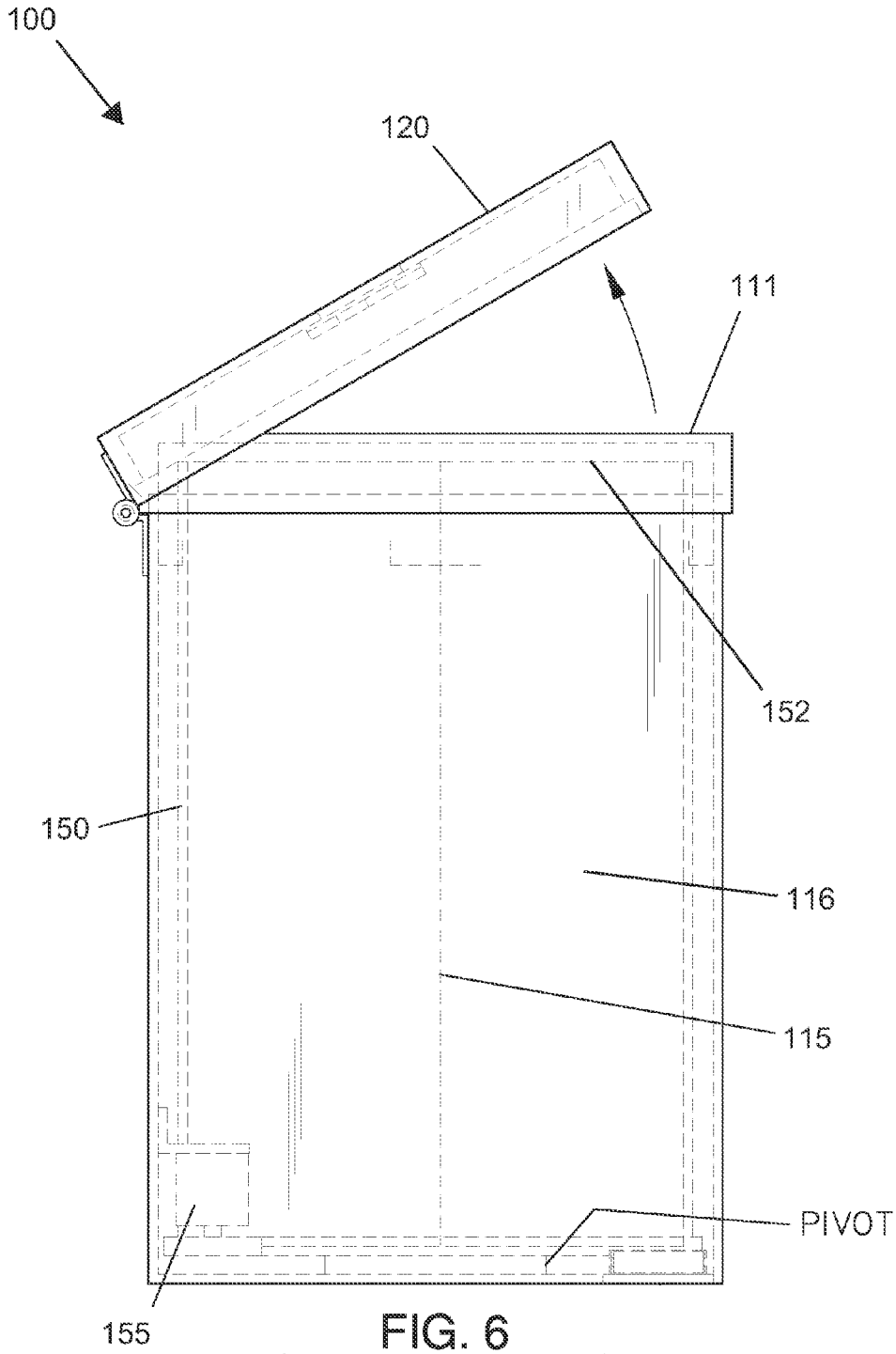
FIG. 6 shows a side view of an alternate embodiment of the present invention.

Following is a list of elements corresponding to a particular element referred to herein:

100 Personal savings system
110 Container
111 Container top
112 Container front surface
115 Divider
116 Chamber
117 Chamber top
120 Lid
121 Lid top surface
122 Lid bottom surface
123 Lid front surface
130 Power supply
131 Microprocessor
132 Display
133 Latch first component
134 Latch second component
135 Money slot
136 User interface component
137 Demo button
140 Battery compartment
150 Cylinder
151 Cylinder top
152 Container top panel bottom surface
155 Motor Referring now to FIG. 1-6, the present invention features a personal saving system (100) for accumulating funds and allowing access to the saved funds after an elapsed timeframe. In some embodiments, the system (100) comprises a sturdy hollow container (110) having at least a partially open container top (111) and one or more vertical dividers (115) disposed therein creating a plurality of chambers (116) having at least a partially open chamber top (117). In some embodiments, the container (110) is rectangular. In some embodiments, the container (110) is cylindrical or another shape. In some embodiments, the container (110) is of sturdy construction, for example, is constructed from metal, wood, glass or thick plastic. In some embodiments, the container (110) is designed to resist breakage and tampering.

In some embodiments, the system (100) features one or more lids (120) pivotally disposed on the container (110). In some embodiments, each lid (120) is spring-biased in an open position. In some embodiments, the lid (120) is of sturdy construction, for example is constructed from metal, wood, glass or a thick plastic.

In some embodiments, the system (100) features an elapsed time latch release system disposed on each lid (120), for example, one lid (120) would have one release system and two lids (120) would have two release systems. In some embodiments, the release system comprises a lithium or alkaline battery power supply (130).

In some embodiments, the release system comprises a microprocessor (131) operatively connected to the power supply (130).

In some embodiments, the release system comprises a display (132) disposed on a lid top surface (121) operatively connected to the microprocessor (131). In some embodiments, the display is a touchscreen and is designed to receive input into the microprocessor (131). In some embodiments, the display (132) is a liquid crystal display or an LED display.

In some embodiments, the release system comprises a latch first component (133) disposed on a lid front surface (123) of each lid (120) operatively connected to the microprocessor (131). In some embodiments, the latch first component (133) has a key or combination based override system for emergency release.

In some embodiments, the release system comprises a latch second component (134) disposed on a container front surface (112) adjacent to the latch first component (133) when the lid (120) is in a closed position. In some embodiments, the latch second component (134) is latchably mated to and interfaces with the latch first component (133).

In some embodiments, the release system comprises a money slot (135) disposed on the lid top surface (121). In some embodiments, the money slot (135) comprises a spring biased slot cover disposed on an underside thereon.

In some embodiments, the release system comprises one or more user interface components (136) disposed on the lid top surface (121) operatively connected to the microprocessor (131). In some embodiments, each user interface component (136) communicates with the microprocessor (131) to program a predetermined elapsed timeframe parameter for release of the lid (120) via the latch first component (133). In some embodiments, the user interface component (136) is a button. In some embodiments, the user interface component (136) is a touchscreen.

In some embodiments, the release system comprises a demo button (137) for initiating a demonstration cycle of the time release system. In some embodiments, if the user does not want to lock it, then just turn the system on or off. If other buttons are pressed, e.g., 1 week or 1 month, then the demo would no longer work because it is locked out.

In some embodiments, the lid (120) is closed and latched via the latch first component (133) and the latch second component (134). In some embodiments, a user places money into the chamber (116) via the money slot (135) and the open chamber top (117). In some embodiments, a time release date is programmed into the microprocessor (131) via the user interface component (136). In some embodiments, the display (132) shows an alphanumeric readout of pertinent data including but not limited to the days remaining until the lid (120) is opened or the time release date the lid (120) is to be opened. In some embodiments, upon reaching the programmed time release date, the latch first component (133) is activated via the microprocessor (131) to unattach from the latch second component (134) thereby opening the spring-biased lid (120) for access to the funds.

In some embodiments, the battery compartment (140) is disposed on a lid bottom surface (122). In some embodiments, the battery compartment (140) is disposed on a lid top surface (121).

In some embodiments, the elapsed timeframe is one day. In some embodiments, the elapsed timeframe is one week. In some embodiments, the elapsed timeframe is one month. In some embodiments, the elapsed timeframe is one year or more.

In some embodiments, the elapsed timeframe is programmable to any desired elapsed timeframe, for example a baby due date, a graduation, a birthday, etc.

In some embodiments, one lid (120) exists for each chamber (116). In some embodiments, each lid (120) fully covers each chamber (116).

In some embodiments, a rotating cylinder (150) having a fully open cylinder top (151) is disposed in the container (110). In some embodiments, the cylinder top (151) is disposed interfacingly against the lid bottom surface (122) and a container top panel bottom surface (152), if present. In some embodiments, one or more vertical dividers (115) is/are disposed in the cylinder (150) creating the plurality of chambers (116). In some embodiments, a motor (155) is operatively coupled to the cylinder (150) for rotation. In some embodiments, the motor (155) is operatively connected to and controlled by the microprocessor (131). In some embodiments, upon reaching the programmed date, the cylinder (150) is rotated to position the open chamber top (117) underneath the open container top (111). In some embodiments, the latch first component (133) is activated via the microprocessor (131) to release from the latch second component (134) thereby opening the spring-biased lid (120) for access to the funds via the open lid (120), the open container top (111), and the open chamber top (117).

As used herein, the term "about" refers to plus or minus 10% of the referenced number.

The disclosures of the following U.S. Patents are incorporated in their entirety by reference herein: U.S. Pat. No. 6,825,753 B2.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A personal saving system (100) for accumulating funds and allowing access to the saved funds after an elapsed timeframe, wherein the system (100) comprises:

(a) a sturdy hollow container (110) having at least a partially open container top (111) and one or more vertical dividers (115) disposed therein creating a plurality of chambers (116) having at least a partially open chamber top (117);

(b) one or more lids (120) pivotally disposed on the container (110), wherein each lid (120) is spring-biased in an open position; and (c) an elapsed time latch release system disposed on each lid (120), wherein the release system comprises:

(i) a lithium or alkaline battery power supply (130), (ii) a microprocessor (131) operatively connected to the power supply (130), (iii) a display (132) disposed on a lid top surface (121) operatively connected to the microprocessor (131), (iv) a latch first component (133) disposed on a lid front surface (123) of each lid (120) operatively connected to the microprocessor (131), (v) a latch second component (134) disposed on a container front surface (112) adjacent to the latch first component (133) when the lid (120) is in a closed position, wherein the latch second component (134) is latchably mated to and interfaces with the latch first component (133), (vi) a money slot (135) disposed on the lid top surface (121), (vii) one or more user interface components (136) disposed on the lid top surface (121) operatively connected to the microprocessor (131), wherein each user interface component (136) communicates with the microprocessor (131) to program a predetermined elapsed timeframe parameter for release of the lid (120) via the latch first component (133), and (viii) a demo button (137) for initiating a demonstration cycle of the time release system;

wherein the lid (120) is closed and latched via the latch first component (133) and the latch second component (134), wherein money is placed into the chamber (116) via the money slot (135) and the open chamber top (117), wherein a time release date is programmed into the microprocessor (131) via the user interface component (136), wherein the display (132) shows an alphanumeric readout of pertinent data including the days remaining until the lid (120) is opened or the time release date the lid (120) is to be opened, wherein upon reaching the programmed time release date, the latch first component (133) is activated via the microprocessor (131) to unattach from the latch second component (134) thereby opening the spring-biased lid (120) for access to the funds;

wherein a rotating cylinder (150) having a fully open cylinder top (151) is disposed in the container (110), wherein the cylinder top (151) is disposed interfacingly against a lid bottom surface (122) and a container top panel bottom surface (152), wherein the one or more vertical dividers (115) is disposed in the cylinder (150) creating the plurality of chambers (116), wherein a motor (155) is operatively coupled to the cylinder (150) for rotation, wherein the motor (155) is operatively connected to and controlled by the microprocessor (131), wherein upon reaching the programmed date, the cylinder (150) is rotated to position the open chamber top (117) underneath the open container top (111), wherein the latch first component (133) is activated via the microprocessor (131) to release from the latch second component (134) thereby opening the spring-biased lid (120) for access to the funds via the open lid (120), the open container top (111), and the open chamber top (117).

* * * * *